US005662331A

United States Patent [19]

Cucci

[11] Patent Number: 5,662,331

[45] Date of Patent: Sep. 2, 1997

[54] MARBLE CAP GAME PLAYING PIECE

[76] Inventor: Charles Cucci, 426 Walnut St., Port Monmouth, N.J. 07758

[21] Appl. No.: 613,333

[22] Filed: Mar. 11, 1996

[51] Int. Cl.[6] ..... A63F 9/00

[52] U.S. Cl. ..... 273/288; 473/588; 273/DIG. 30; 206/315.1

[58] Field of Search ..... 273/288, 291, 273/DIG. 30; 206/315.1, 813; 473/588, 589

[56] References Cited

U.S. PATENT DOCUMENTS

| | | | |
|---|---|---|---|
| 2,847,222 | 8/1958 | Weeks | 273/288 X |
| 4,226,420 | 10/1980 | Corday | 273/DIG. 30 |
| 4,354,282 | 10/1982 | Langdon | 273/DIG. 30 |
| 4,736,955 | 4/1988 | Pollock | 273/DIG. 30 |
| 4,949,978 | 8/1990 | Berner | 273/288 |
| 5,031,918 | 7/1991 | Brill | 273/288 |
| 5,067,727 | 11/1991 | Crompton | 473/589 X |
| 5,538,129 | 7/1996 | Chester et al. | 206/813 X |
| 5,586,763 | 12/1996 | De Bono et al. | 206/315.1 X |

FOREIGN PATENT DOCUMENTS

| | | | |
|---|---|---|---|
| 675695 | 10/1990 | Switzerland | 273/288 |

OTHER PUBLICATIONS

"Skelly", *Games,* Workman Pub. Co. Sep. 1975, p. 230.

*Primary Examiner*—William E. Stoll
*Attorney, Agent, or Firm*—Charles I. Brodsky

[57] ABSTRACT

A game playing piece is described for playing a game laid out on a flat street, sidewalk or driveway surface, having a generally rounded disc shape of diameter 3–4 times greater than its thickness, a flat bottom, and composed substantially entirely of glass, adapted for finger actuating propulsion along the laid-out playing field.

9 Claims, 2 Drawing Sheets

MARBLE CAP GAME PLAYING PIECE

FIELD OF THE INVENTION

This invention relates to the playing of street games and, more particularly, to the playing of a street game sometimes called "Bottlecaps", sometimes called "Skelly", and at other times called by various names, as was, and still is, played in inner city communities.

BACKGROUND OF THE INVENTION

As is known, such street game—referred to here as "Bottle-caps"—employed the laying out of a playing field on a street, sidewalk or driveway of approximately some 4–6 feet square, and then propelling a bottle cap in a prescribed manner from one point on the playing field to another in predetermined sequence. A typical playing field, for example, would there utilize four corner boxes along the square configuration, two more on each side of the square between the corners, and a further box in the center of the square layout. As will be understood, the game would be played by finger actuating a bottle cap around this course, from one numbered box to another, in prescribed sequence. In the more common version of playing this type of game, the layout is usually just inscribed on the ground itself with a sharp stone—where a piece of chalk were had, on the other hand, the layout could be put down the ground in bolder, more pronounced manner.

In the most usual way of playing the game, the cap from off a soda bottle or beer bottle was employed—of the type that one would pry off the bottle with a bottle opener, to free the clinched cap secured to keep the contents fresh. To make the cap slide more evenly along the ground, the player would usually scrape the bottom surface of the cap to remove the overlying layer of paint with its advertising from the surface. In order to give the cap stability in play—and to prevent it from being knocked far astray when struck by another player's cap according to the manner of play—it was not uncommon to fill the cap with a weighted material. Oftentimes the caulk insides of the cap were first cleaned out—but whether or not that caulk was removed, the filling material took on the nature of melted wax, orange peels cut to fill the cap, or tar dug out from the heated street itself.

As will be appreciated, some of the limitations as to this were the difficulty of finding a candle to light and melt so as to obtain the dripping wax in sufficient quantity to fill the bottle cap once the wax hardened; another limitation was that the orange peel, or similar filler oftentimes came loose in play, and had a reduced weight as a support. With respect to the filling of the bottle cap with "tar", on the other hand, it was necessary to find a street made of this material, and soft enough under the summer sun to be able to be pried out and then placed into the bottle cap to fill it and weigh it down. As will be appreciated, further, on the other hand, it will be understood that these types of bottle caps which close off soda and beer bottles are no longer in vogue—as modern industrial techniques have replaced those caps with screw-caps, to be twisted on and off the bottles when opening and closing them. Thus, the availability of these caps to be filled in playing this type of street game, has been significantly reduced.

OBJECTS OF THE INVENTION

It is an object of the present invention, therefore, to provide a new type of playing piece to be used in playing this type of game referred to as "Bottlecaps".

It is an object of the invention, also, to provide such playing piece which is readily purchasable, and which does not need first the obtaining of an available playing piece, and then having to be filled in by the user in order to play the game itself.

It is another object of the invention to provide this type of playing piece, in a manner which continues to be obtainable at a price which can be afforded—even by disadvantaged children, so as to rejuvenate the playing of this well-known type of street game.

SUMMARY OF THE INVENTION

As will become clear from the following description, the game playing piece of the invention combines this prior art bottle cap with another common street game, the playing of "marbles". More particularly, and as will be seen, the previous bottle cap game piece is here composed substantially entirely of glass, according to the invention, of a generally rounded disc shape, having a flat bottom, and a diameter 3–4 times greater than its thickness. In accordance with the invention, in one of its embodiments, the game piece is composed substantially entirely of marble glass—in some cases, being colored, and others being multicolored, and in still others, being composed substantially entirely of transparent marble glass.

As will also be described, this utilization of a game piece thus adapted for finger actuating propulsion along a playing field of predetermined configuration, also allows for the packaging of a plurality of these game pieces within a wrapper enclosing a backing on which several of these game pieces are mounted. In one embodiment of the invention, to be described, a hook-and-loop adhesive backing may be employed to mount the game pieces on the backing—and, where desired, a piece of chalk can further be detachably secured with the backing for laying out the playing field where desired. In one further embodiment to be described, the wrapper can also enclose a set of printed instructions on the backing as to one manner for laying out the playing field on a flat street, sidewalk or driveway surface, where the game is to be played.

In one preferred embodiment of the invention, furthermore, a game piece in this manner is selected to have a diameter of substantially two inches, larger than the previously employed soda bottle or beer bottle cap clinched onto the bottle of the neck, with the diameter of the order of only one inch.

BRIEF DESCRIPTION OF THE DRAWINGS

These and other features of the present invention will be more clearly understood from a consideration of the following description, taken in connection with the accompanying drawing, in which.

DETAILED DESCRIPTION OF THE DRAWING

Figure 1:
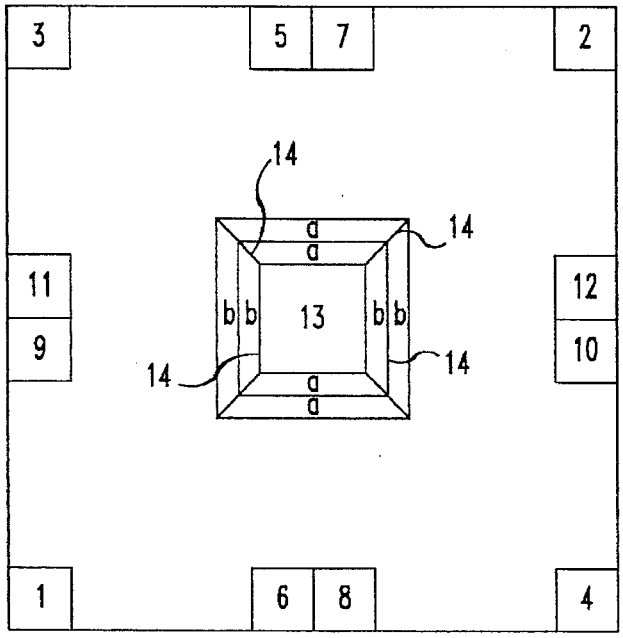
FIG. 1 illustrates a typical playing field for the game of "Bottlecaps" as may be utilized with the game piece of the invention.

Referring to FIG. 1, a typical playing field for the "Bottlecaps" game is shown as being some 4–6 feet square, with four boxes at its respective corners, numbered 1–4. A pair of adjacent boxes are laid out in each side as shown, between adjacent corners, and numbered as shown from 5 through 12. A further box numbered 13 is shown at substantially the center of the square, and is sometimes referred to as a spider web.

In a typical playing of the game with the playing field of FIG. 1, the players choose who is to be first, with that player then placing his bottle cap in box 1, then shooting for box 2. If he makes it into box 2 in one shot, that player then tries for box 3. If he shoots and misses at any time, that player then waits his turn while the other players proceed. Thus, player 2—and the others in their turn—places his or her bottle cap into box 1 and follows the same procedure, shooting for box 2 by finger actuating the playing piece for propulsion along the street, sidewalk or driveway surface. Alternatively to shooting into the box being aimed at, that player may alternatively shoot his playing piece to hit the piece of a preceding player; and, if successful, to then immediately go into the box being approached, to shoot towards the next box the prescribed sequence. The game playing—as well as other variants of it as decided upon by the participants—continues in this manner, until a player then aims for box 13. There, the object is to shoot into the box without touching the individual lines 14 forming the "web" 13—where upon if he does, that player's turn is terminated. Once arriving safely in box 13, the playing sequence is reversed, shooting back for box 12, then 11, 10, etc. in turn, until reaching box 1 and being declared the winner. In other street versions of the game, the instructions for play could be to arrive in box 13 without landing in the spaces denoted by the letters "a" or "b", but which can be arrived at just by staying on the lines 14 in approaching box 13.

Figure 2:
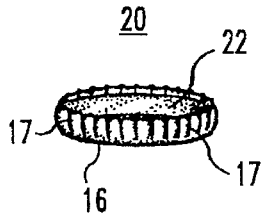
FIG. 2 PRIOR ART
FIG. 2 is a perspective view of a bottle cap of the type known in the prior art for use on a playing field of the type of FIG. 1, showing the manner of its being clinched onto a soda or beer bottle neck.

FIG. 2 shows a type of bottle cap as known as the prior art in playing this type of street game. Understood as being of the type to close off soda bottle, beer bottles and the like, such game playing piece generally has a flat bottom 16 and series of cinches 17 which close around the neck of the soda bottle or beer bottle in known manner, to seal it off. Whether the cap 20 be off these, or other bottles, it is typically of a 1 inch diameter, and is filled, as at 22, with some type of weighted material—either wax, orange peel, tar or other available material.

Figure 3:
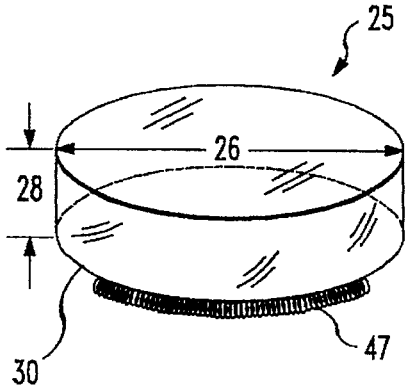
FIG.3 illustrates a game playing piece embodying the invention.

As shown in FIG. 3, on the other hand, the game playing piece 25 of the invention similarly has a generally rounded disk shape of a diameter 26 substantially 3–4 times greater than its thickness 28, along with a like flat bottom 30 as with the game piece of FIG. 2. However, and in accordance with the invention, such game playing piece 25 is composed substantially entirely of glass—and preferably substantially entirely of marble glass. As is known, such marble glass is available in "colored" form, as compared to be just plain white—and, in accordance with the invention, could be composed substantially entirely of multicolored marble glass as well, incorporating such other colors as black and red to stand out in catching the light as it is propelled from one box to another. In accordance with the teachings herein, such marble glass could likewise be transparent, and can be of a variegated composition to provide a "kaleidoscope" effect as it is being spun about in catching sunlight as it is shot from one location to another.

In accordance with the preferred embodiment, furthermore, the playing piece 25 is not only composed of a diameter 26 3–4 times greater than its thickness 28, but of a diameter substantially 2 inches, 4 times greater, so as to be larger than the typical 1 inch diameter of the bottle cap of FIG. 2, and at the same time so as to be heavier than that bottle cap when filled in the prior art manners. Such larger size enables it to be more easily played with in being propelled by finger actuation across the street, sidewalk or driveway surface, both for easier play as well as to present a more eye catching appearance.

Figure 4:
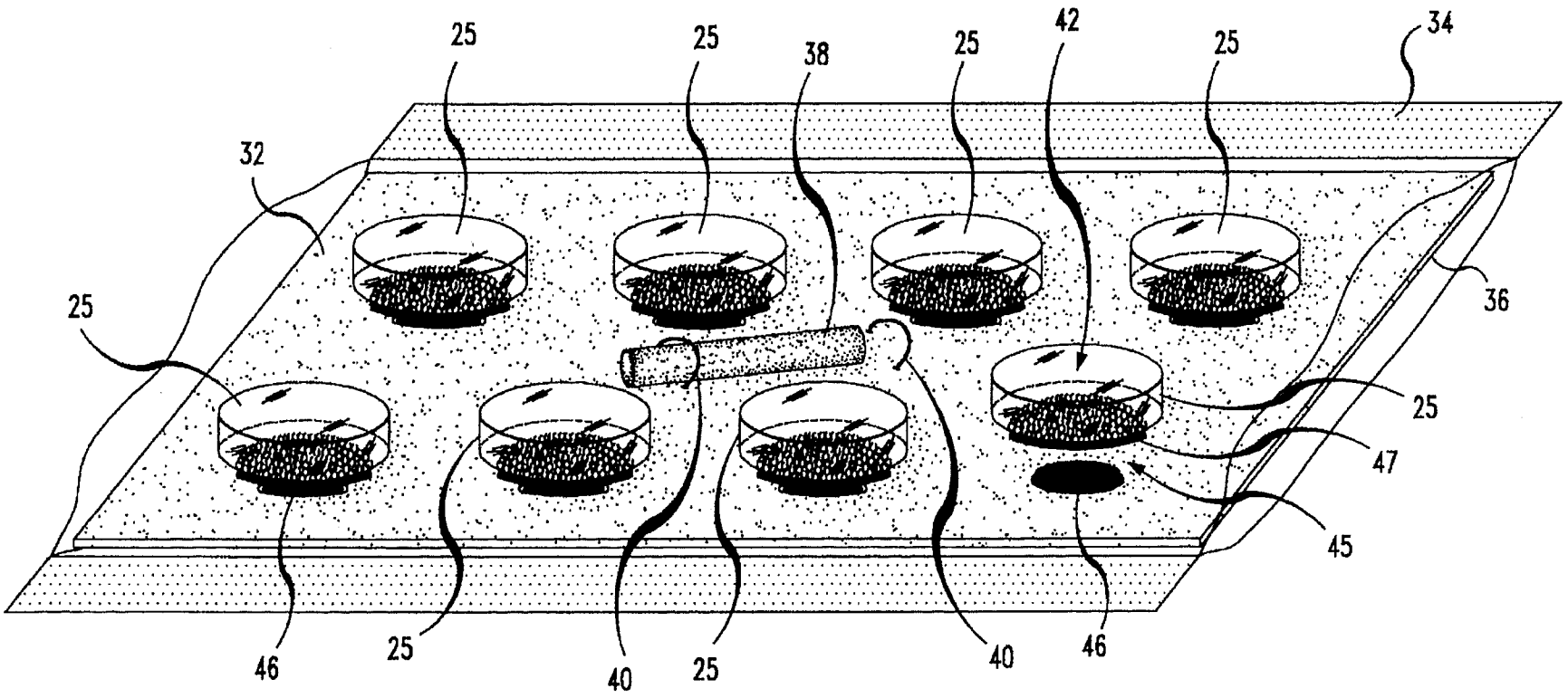
FIG. 4 shows a plurality of the game pieces of the invention as they might be packaged on a backing, and enclosed within a wrapper for final distribution and sale.

As will be readily appreciated by those skilled in the art, the playing piece 25 of FIG. 3 can be sold loosely, as individual bottle cap game pieces. Alternatively, and as illustrated in FIG. 4, the playing piece 25 can also be sold as a package, in which a plurality of such game pieces are enclosed. There, seven such playing pieces are enclosed on a backing 32 (cardboard, plastic, etc.) within a wrapper 34—plastic, or as part of an overall blister-pack construction. In such arrangement, the directions for laying out and playing the "Bottlecap" game can be printed on the underside of the backing 32, as at 36, and a piece of chalk 38 may be included held in place as at 40 until needed in laying out the playing field. As shown separately, an eighth playing piece 42 is illustrated apart from the backing 32 to illustrate a manner of holding the playing piece 25 in place on the backing 32, as with a hook-and-loop adhesive 45, or double-sided tape, one of which 46 is secured to the backing 32, and another of which 47 can be releasably peeled away from the playing piece once it is removed from the wrapper 34 and made ready for use in the actual playing of the game.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

I claim:

1. The combination comprising:

a plurality of game pieces adapted for finger actuating propulsion along a playing field of predetermined configuration, each of which is composed substantially entirely of marble glass having a generally rounded disc shape of diameter 3–4 times greater than its thickness and having a flat bottom;

a backing;

means for mounting each of said plurality of game pieces on said backing; and a wrapper enclosing said plurality of game pieces and said backing.

2. The combination of claim 1, wherein said mounting means includes a hook-and-loop adhesive backing for each of said game pieces.

3. The combination of claim 1, wherein there is also included a piece of chalk detachably secured with said backing for laying out said playing field on a flat street, sidewalk or driveway surface.

4. The combination of claim 1, wherein there is also included a set of printed instructions on said backing for laying out said playing field on a flat street, sidewalk or driveway surface, and for playing a described game thereon.

5. The combination of claim 1 wherein said game pieces are composed substantially entirely of glass.

6. The combination of claim 5 wherein each game piece is composed substantially entirely of colored glass.

7. The combination of claim 5 wherein each game piece is composed substantially entirely of multicolored glass.

8. The combination of claim 5 wherein each game piece is composed substantially entirely of transparent glass.

9. The combination of claim 5 wherein each game piece has a diameter of substantially 2 inches.

* * * * *